US007073783B1

(12) United States Patent
Somerville et al.

(10) Patent No.: US 7,073,783 B1
(45) Date of Patent: Jul. 11, 2006

(54) HYDRAULIC-OPERATED VISE DEVICE

(76) Inventors: Dean S. Somerville, P.O. Box 246, 805 Sunflower Ave., Cooperstown, ND (US) 58425; Tohn J. Dahl, P.O. Box 246, 805 Sunflower Ave., Cooperstown, ND (US) 58425

( * ) Notice: Subject to any disclaimer, the term of this patent is extended or adjusted under 35 U.S.C. 154(b) by 182 days.

(21) Appl. No.: 10/889,891

(22) Filed: Jul. 13, 2004

(51) Int. Cl.
*B25B 1/24* (2006.01)

(52) U.S. Cl. ..... 269/25

(58) Field of Classification Search ..... 269/25, 269/247, 27, 100, 268
See application file for complete search history.

(56) References Cited

U.S. PATENT DOCUMENTS 2,596,853 A * 5/1952 Helstrom ..... 269/25
4,763,887 A * 8/1988 Yang ..... 269/247

* cited by examiner

*Primary Examiner*—Robert C. Watson
(74) *Attorney, Agent, or Firm*—David A. Lingbeck

(57) ABSTRACT

A hydraulic-operated vise device for holding and clamping objects for working on the objects. The hydraulic-operated vise device includes a base assembly including a housing sleeve and also including a first jaw member being attached to the housing sleeve; and includes an elongate housing member being movably disposed through the housing sleeve; and also includes a second jaw member being attached to the elongate housing member and being movable away from and toward the first jaw member for clamping objects between the first and second jaw members; and further includes an actuator assembly for moving the elongate housing member through the housing sleeve and for moving the second jaw member away from and toward the first jaw member.

15 Claims, 4 Drawing Sheets

HYDRAULIC-OPERATED VISE DEVICE

BACKGROUND OF THE INVENTION

1. Field of the Invention

The present invention relates to hydraulic vises and more particularly pertains to a new hydraulic-operated vise device for holding and clamping objects for working on the objects.

2. Description of the Prior Art

The use of hydraulic vises is known in the prior art. More specifically, hydraulic vises heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,458,097; U.S. Pat. No. 5,133,536; U.S. Pat. No. 3,927,872; U.S. Pat. No. 2,345,401; U.S. Pat. No. 3,063,708; and U.S. Pat. No. 2,693,727.

While these devices fulfill their respective, particular objectives and requirements, the aforementioned patents do not disclose a new hydraulic-operated vise device. The prior art includes hydraulic vises which have jaw members being moved by pistons but which are structured unlike the present invention

SUMMARY OF THE INVENTION

The general purpose of the present invention, which will be described subsequently in greater detail, is to provide a new hydraulic-operated vise device which has many of the advantages of the hydraulic vises mentioned heretofore and many novel features that result in a new hydraulic-operated vise device which is not anticipated, rendered obvious, suggested, or even implied by any of the prior art hydraulic vises, either alone or in any combination thereof. The present invention includes a base assembly including a housing sleeve and also including a first jaw member being attached to the housing sleeve; and also includes an elongate housing member being movably disposed through the housing sleeve; and also includes a second jaw member being attached to the elongate housing member and being movable away from and toward the first jaw member for clamping objects between the first and second jaw members; and further includes an actuator assembly for moving the elongate housing member through the housing sleeve and for moving the second jaw member away from and toward the first jaw member. None of the prior art includes the combination of the elements of the present invention.

There has thus been outlined, rather broadly, the more important features of the hydraulic-operated vise device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new hydraulic-operated vise device which has many of the advantages of the hydraulic vises mentioned heretofore and many novel features that result in a new hydraulic-operated vise device which is not anticipated, rendered obvious, suggested, or even implied by any of the prior art hydraulic vises, either alone or in any combination thereof.

Still another object of the present invention is to provide a new hydraulic-operated vise device for holding and clamping objects for working on the objects.

Still yet another object of the present invention is to provide a new hydraulic-operated vise device that allows the user to automatically clamp and hold an object in a vise without the user having manually operate the vise.

Even still another object of the present invention is to provide a new hydraulic-operated vise device that is easy and convenient to operate automatically.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
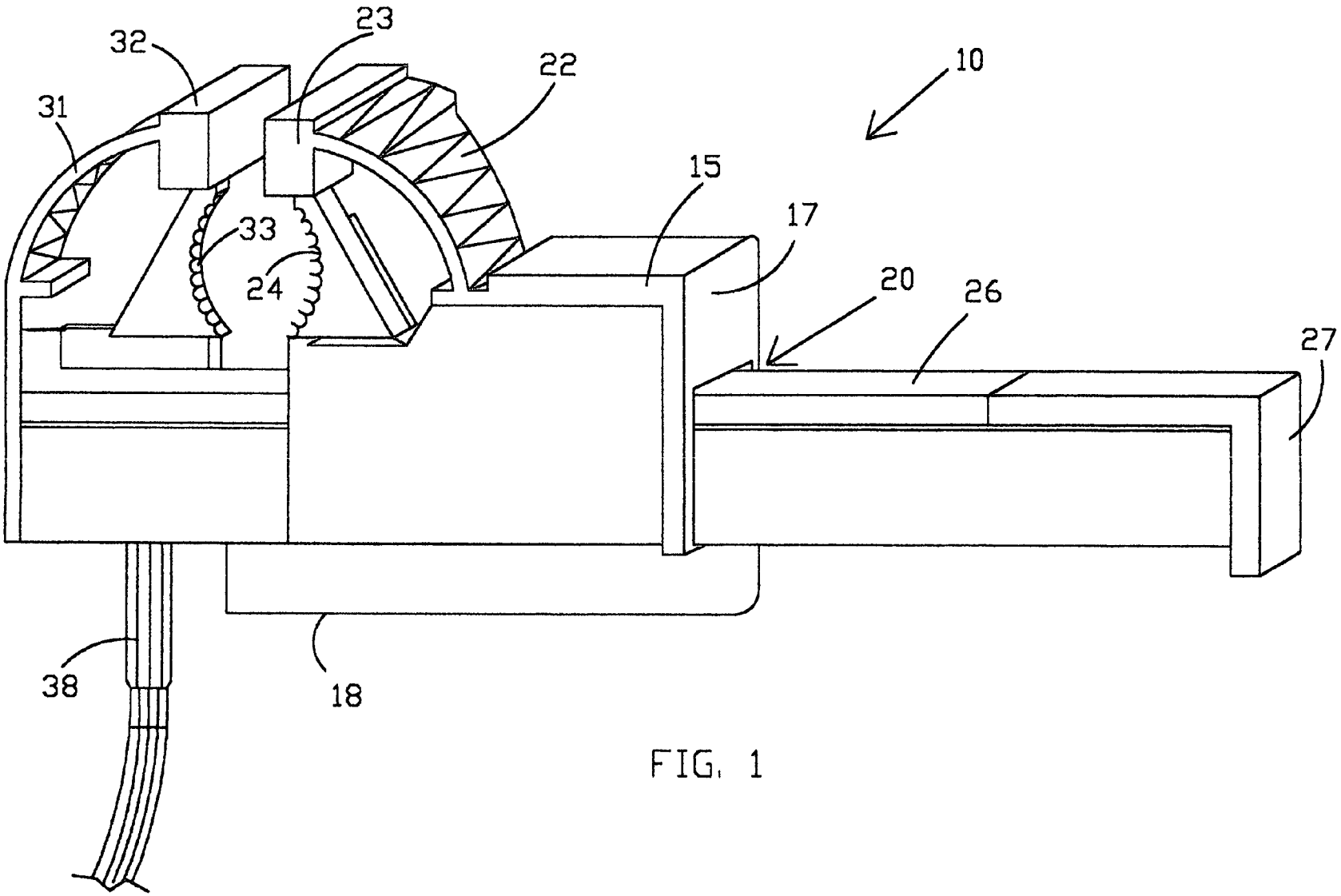
FIG. 1 is a front elevational view of a new hydraulic-operated vise device according to the present invention.
Figure 2:
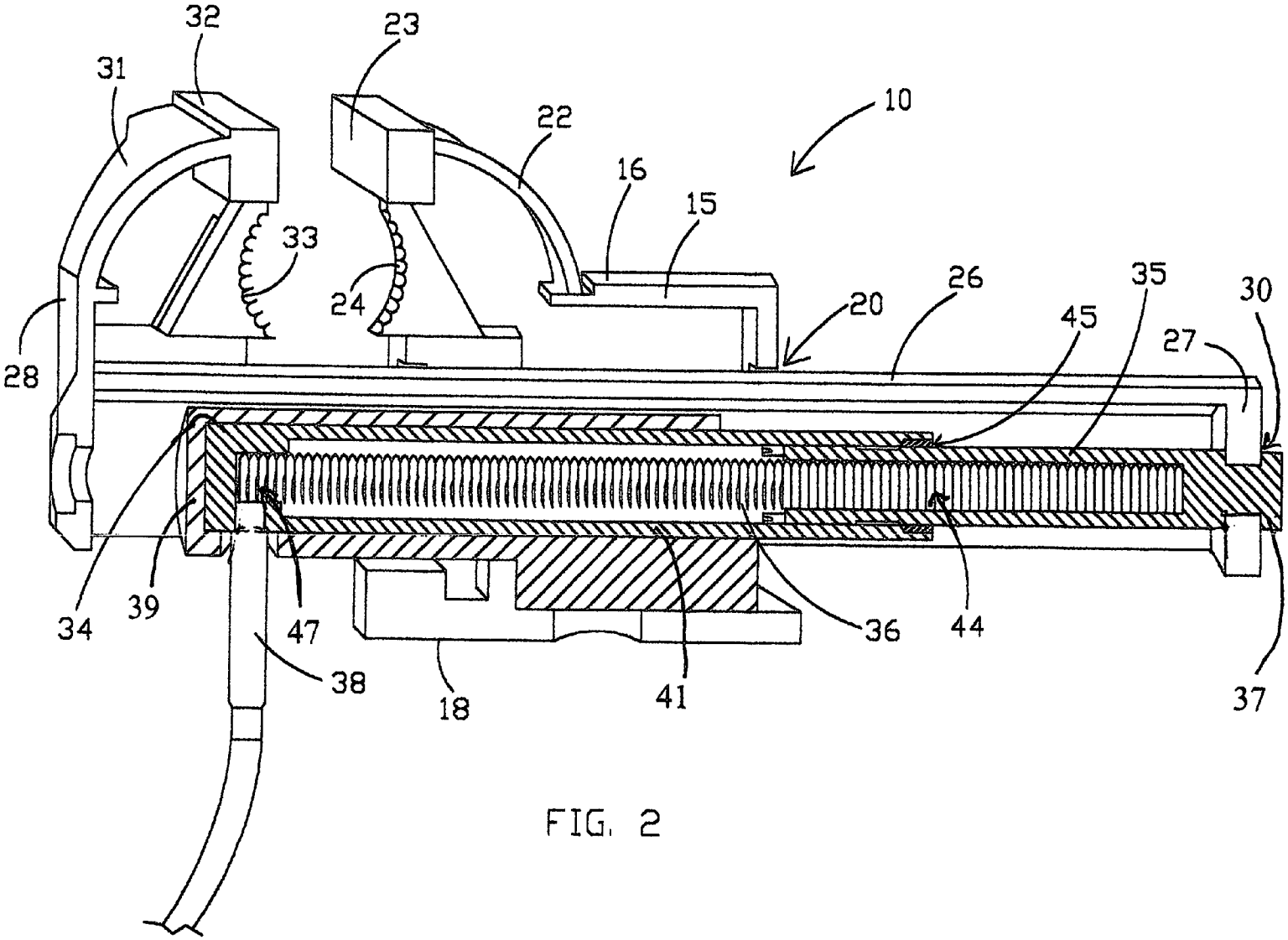
FIG. 2 is a top perspective view of the present invention.
Figure 3:
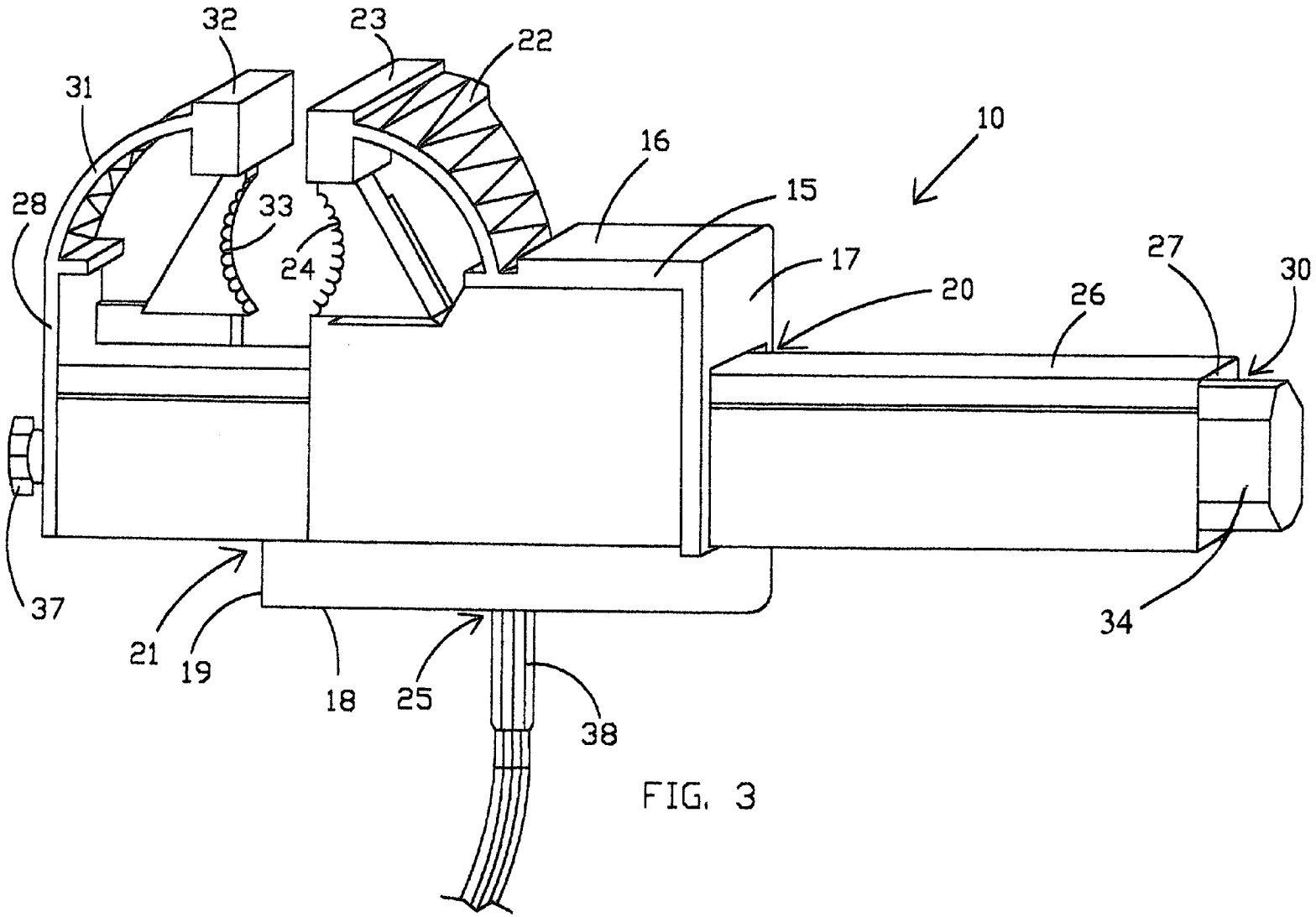
FIG. 3 is a side edge elevational view of the present invention.
Figure 4:
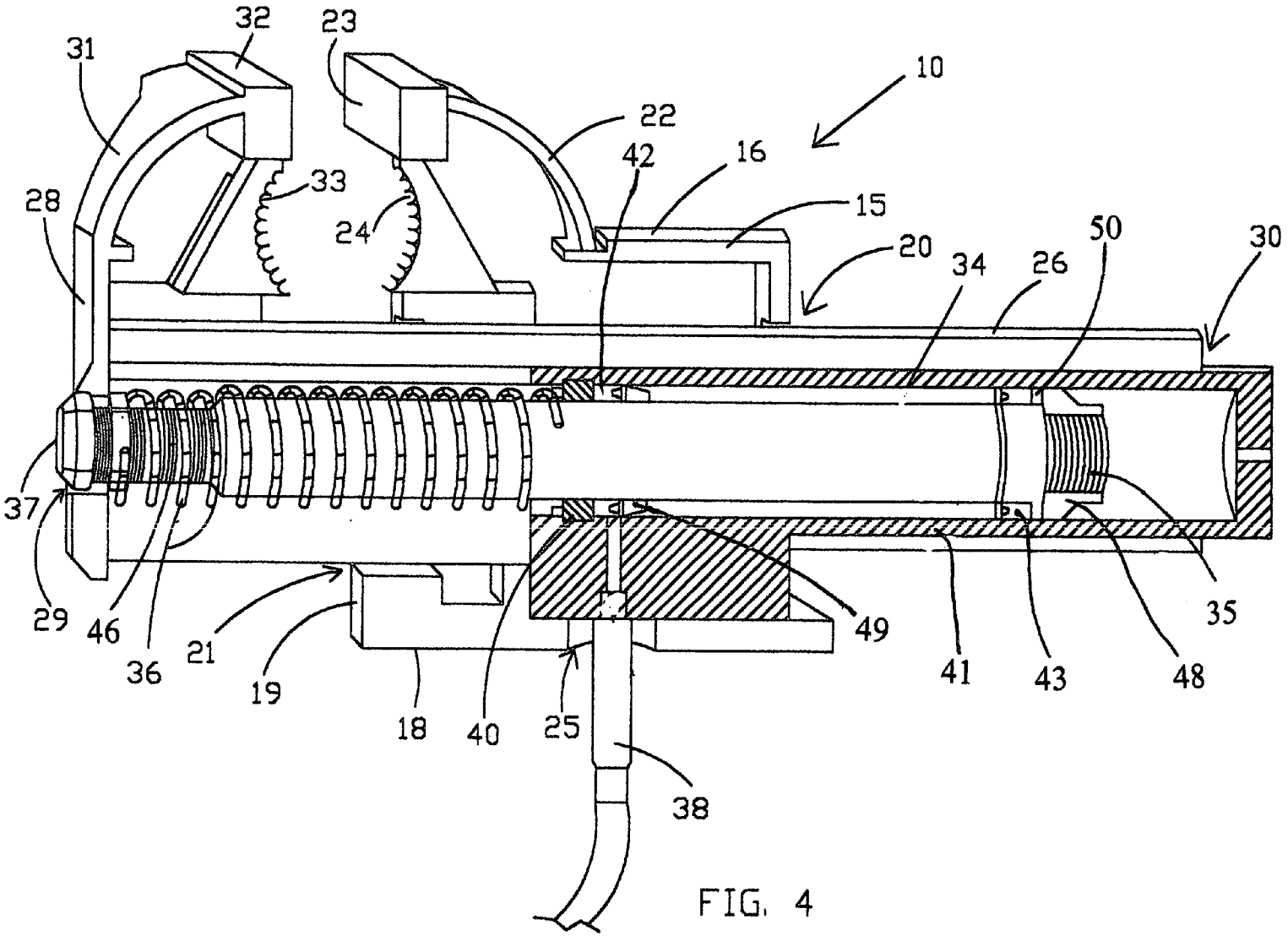
FIG. 4 is a side edge elevational view of the present invention.

With reference now to the drawings, and in particular to FIGS. 1 through 4 thereof, a new hydraulic-operated vise device embodying the principles and concepts of the present invention and generally designated by the reference numeral 10 will be described.

As best illustrated in FIGS. 1 through 4, the hydraulic-operated vise device 10 generally comprises a base assembly including a housing sleeve 15 and also including a first jaw member 22 being securely and conventionally attached and welded to the housing sleeve 15. The housing sleeve 15 includes top and bottom walls 16,18 and also includes open first and second ends 17,19. The bottom wall 18 has holes therein for fastening to a support structure. The first jaw member 22 includes a lower portion 24 being securely and conventionally attached upon the top wall 16 and near the first end 19 of the housing sleeve 15, and also includes an upper portion 23. The lower portion 24 of the first jaw member 22 includes an inwardly-bowed, serrated side edge.

The upper portion 23 of the first jaw member 22 includes a planar side wall being disposed above the inwardly-bowed, serrated side edge.

As a first embodiment, the base assembly further includes a cylinder support member 39 being securely disposed in the housing sleeve 15 and being conventionally attached and welded to the bottom wall 18 of the housing sleeve 15. The cylinder support member 39 includes a side wall which is securely and conventionally attached and welded to the bottom wall 18 of the housing sleeve 15, and also includes a closed end and an open end. The cylinder support member 39 also includes a bore being disposed through the side wall thereof.

An elongate housing member 26 is movably disposed through the housing sleeve 15. The elongate housing member 26 is movably disposed in and through the housing sleeve 15 and has openings 29,30 through first and second ends 27,28 thereof and also has an open bottom.

A second jaw member 31 is securely attached and welded to the elongate housing member 26 and is movable away from and toward the first jaw member 22 for clamping objects between the first and second jaw members 22,31. The second jaw member 31 includes a lower portion 33 being securely and conventionally attached and welded upon a top wall and near the first end 28 of the elongate housing member 26, and also includes an upper portion 32. The lower portion 33 of the second jaw member 31 includes an inwardly-bowed, serrated side edge facing the inwardly-bowed, serrated side edge of the first jaw member 22 for clamping about tubular objects. The upper portion 32 of the second jaw member 31 includes a planar side wall being disposed above the inwardly-bowed, serrated side edge and facing planar side wall of the first jaw member 22.

An actuator assembly for moving the elongate housing member 26 through the housing sleeve 15 and for moving the second jaw member 31 away from and toward the first jaw member 22 includes a cylinder 34 having a side wall and also having a closed end and an open end, and also includes a piston 35 being movably disposed in and out of the cylinder 34 through the open end of the cylinder 34 and also being securely and conventionally attached to the elongate housing member 26, and further includes a spring 36 being conventionally attached to the piston 35 and to the cylinder 34 for moving the piston 35 relative to the cylinder 34; and also includes a conduit 38 being conventionally extended into the cylinder 34 through a side wall thereof and being adapted to be connected to a fluid source for transporting hydraulic fluid into the cylinder 34 with the hydraulic fluid being used to move the piston 35 relative to the cylinder 34.

As a first embodiment, the cylinder 34 is conventionally and securely disposed in the cylinder support member 39. Also, the actuator assembly includes a fastener 37 being fastened about a distal end of the piston 35 and being engaged to the second end 27 of the elongate housing member 26. The piston 35 has a bore 44 being disposed therein through a first end thereof. The cylinder 35 has a slot 47 being disposed in an interior of the closed end. The spring 36 is conventionally disposed in the bore 44 of the piston 35 and in the slot 47 of the cylinder 34.

As a second embodiment, the piston 35 has a threaded shaft portion 46 and also has an annular flange portion 48 at an end opposite the threaded shaft portion 46. The actuator assembly further includes the fastener 37 being threaded about the threaded shaft portion 46 of the piston 35 and being engaged to the first end 28 of the elongate housing member 26. The actuator assembly also includes first and second seal members 42,43 being securely and conventionally attached about the piston 35 in the cylinder 34 and being spaced apart to prevent hydraulic fluid from leaking out of the cylinder 34. A spacer member 49 is conventionally disposed about the piston 35 in the cylinder 34 to prevent the piston 35 from blocking the conduit 38 extending into the cylinder 34. Also, a spring stop member 40 is securely and conventionally attached about the cylinder 34 near the open end thereof with the spring 36 resting against the spring stop member 40. Further, a seal support member 50 is disposed against the annular flange portion 48 of the piston 35 for supporting the second seal member 43 which is disposed adjacent to the annular flange portion 48 of the piston 35.

In use, the user places an object between the first and second jaw members 22,31 and actuates the piston 35 by allowing hydraulic fluid to flow into the cylinder 34 which urges and moves the piston 35 relative to the cylinder 34 which also moves the second jaw member 31 toward the first jaw member 22 thus clamping the object between the first and second jaw members 22,31. To release the first and second jaw members 22,31 about the object, the user conventionally stops the flow of hydraulic fluid into the cylinder 34 which allows the spring 36 to move the piston 35 such that the second jaw member 31 is moved away from the first jaw member 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the hydraulic-operated vise device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hydraulic-operated vise device comprising:

a base assembly including a housing sleeve and also including a first jaw member being attached to said housing sleeve, said housing sleeve including top, side and bottom walls and also including open first and second ends, said bottom wall having holes therein for fastening to a support structure;

an elongate housing member being movably disposed through said housing sleeve, said elongate housing member being movably disposed in and through said housing sleeve and having openings through first and second ends thereof and also having an open bottom;

a second jaw member being attached to said elongate housing member and being movable away from and toward said first jaw member for clamping objects between said first and second jaw members; and an actuator assembly for moving said elongate housing member through said housing sleeve and for moving said second jaw member away from and toward said first jaw member.

2. The hydraulic-operated vise device as described in claim 1, wherein said second jaw member includes a lower portion being securely attached upon said top wall and near said first end of said elongate housing member, and also includes an upper portion.

3. The hydraulic-operated vise device as described in claim 2, wherein said lower portion of said second jaw member includes an inwardly-bowed, serrated side edge facing said first jaw member for clamping about tubular objects.

4. The hydraulic-operated vise device as described in claim 3, wherein said upper portion of said second jaw member includes a planar side wall being disposed above said inwardly-bowed, serrated side edge and facing said first jaw member.

5. The hydraulic-operated vise device as described in claim 1, wherein said base assembly further includes a cylinder support member being disposed in said housing sleeve and being attached to said bottom wall of said housing sleeve.

6. The hydraulic-operated vise device as described in claim 5, wherein said cylinder support member includes a side wall which is securely attached to said bottom wall of said housing sleeve, and also includes a closed end and an open end.

7. The hydraulic-operated vise device as described in claim 6, wherein said cylinder support member also includes a bore being disposed through said side wall thereof.

8. The hydraulic-operated vise device as described in claim 4, wherein said actuator assembly includes a cylinder having a side wall and further having a closed end and an open end; and also includes a piston being movably disposed in and out of said cylinder through said open end of said cylinder and also being attached to said elongate housing member, and further includes a spring being attached to said piston and to said cylinder for moving said piston relative to said cylinder, and also includes a conduit being extended into said cylinder and being adapted to be connected to a fluid source for transporting hydraulic fluid into said cylinder, said hydraulic fluid being used to move said piston relative to said cylinder.

9. The hydraulic-operated vise device as described in claim 8, wherein said cylinder is securely disposed in said cylinder support member, said actuator assembly also including a conduit being extended through said bore of said cylinder support member and being extended into said cylinder through a side wall thereof and being adapted to be connected to a fluid source for transporting hydraulic fluid into said cylinder with the hydraulic fluid being used to move said piston relative to said cylinder, and further including a fastener being fastened about a distal end of said piston and being engaged to said second end of said elongate housing member.

10. The hydraulic-operated vise device as described in claim 9, wherein said piston has a bore being disposed therein through a first end thereof.

11. The hydraulic-operated vise device as described in claim 10, wherein said cylinder has a slot being disposed in an interior of said closed end.

12. The hydraulic-operated vise device as described in claim 11, wherein said spring is disposed in said bore of said piston and in said slot of said cylinder.

13. The hydraulic-operated vise device as described in claim 8, wherein said piston has a threaded shaft portion and also has an annular flange portion at an end opposite said threaded shaft portion.

14. The hydraulic-operated vise device as described in claim 13, wherein said actuator assembly further includes a fastener being threaded about said threaded shaft portion of said piston and being engaged to said first end of said elongate housing member.

15. The hydraulic-operated vise device as described in claim 14, wherein said actuator assembly also includes first and second seal members being securely attached about said piston in said cylinder and being spaced apart to prevent hydraulic fluid from leaking out of said cylinder; and further includes a spacer member being disposed about said piston in said cylinder to prevent said piston from blocking said conduit extending into said cylinder; and also includes a spring stop member being securely attached about said cylinder near said open end thereof with said spring resting against said spring stop member; and further includes a seal support member being disposed against said annular flange portion of said piston for supporting said second seal member which is disposed adjacent to said annular flange portion of said piston.

* * * * *